US006739024B1

(12) United States Patent
Wagner

(10) Patent No.: US 6,739,024 B1
(45) Date of Patent: May 25, 2004

(54) METHOD AND DEVICE FOR PRODUCING A STRUCTURED, VOLUMINOUS NON-WOVEN WEB OR FILM

(75) Inventor: Werner Wagner, Alcudia (ES)

(73) Assignee: HCD Hygienic Composites Development GmbH, Muelheim an der Ruhr (DE)

( * ) Notice: Subject to any disclaimer, the term of this patent is extended or adjusted under 35 U.S.C. 154(b) by 0 days.

(21) Appl. No.: 09/857,365

(22) PCT Filed: Dec. 3, 1999

(86) PCT No.: PCT/EP99/09484

§ 371 (c)(1),
(2), (4) Date: Jun. 25, 2001

(87) PCT Pub. No.: WO00/34562

PCT Pub. Date: Jun. 15, 2000

(30) Foreign Application Priority Data

Dec. 4, 1998 (DE) ..... 198 56 223

(51) Int. Cl.[7] ..... D06C 23/00

(52) U.S. Cl. ..... 28/106; 28/170; 26/7; 264/156

(58) Field of Search ..... 28/165, 170, 106, 28/100, 299, 163, 140; 26/51, 29 R, 7; 264/145, 156, DIG. 47, 119, 154, 155; 225/1, 2, 3, 4, 94, 95, 96, 97, 103, 104; 83/30, 660, 39, 49, 663, 667, 669

(56) References Cited

U.S. PATENT DOCUMENTS 3,081,501 A * 3/1963 Kalwaites ..... 28/106
3,137,893 A * 6/1964 Gelpke ..... 264/555
3,325,868 A * 6/1967 Kalwaites ..... 28/106
3,555,601 A * 1/1971 Price ..... 425/327
3,595,454 A * 7/1971 Kalwaites ..... 225/3
3,596,816 A * 8/1971 Brown ..... 225/2
3,969,565 A * 7/1976 Forrest ..... 264/284
4,153,664 A * 5/1979 Sabee ..... 264/280
4,220,272 A * 9/1980 Danti ..... 225/2
4,248,822 A * 2/1981 Schmidt ..... 264/154
4,280,978 A * 7/1981 Dannheim et al. ..... 264/156
4,333,979 A * 6/1982 Sciaraffa et al. ..... 428/179
4,842,794 A * 6/1989 Hovis et al. ..... 264/145
4,913,911 A * 4/1990 Wildt ..... 264/284
5,628,097 A * 5/1997 Benson et al. ..... 28/165
5,704,101 A * 1/1998 Majors et al. ..... 26/18.6
6,395,211 B1 * 5/2002 Dettmer et al. ..... 264/156

FOREIGN PATENT DOCUMENTS

DE 7804478 1/1981
DE 19524076 10/1996
DE 19547319 6/1997

* cited by examiner

*Primary Examiner*—A. Vanatta
(74) *Attorney, Agent, or Firm*—Milde & Hoffberg, LLP

(57) ABSTRACT

The invention relates to a method for producing a structured, voluminous non-woven web or velourised film from a thermoplastic by producing an unstructured web and subsequently processing this web using a pair of rollers (10*a*, 10*b*). The pair of rollers consists of a positive roller (10*a*) having numerous positive bodies distributed over the roll sleeve surface and a negative roller (10*b*) having equally as numerous cavities. During the rolling process, the positive bodies engage with the cavities and stretch the unstructured web in the area of the roller engagements in such a way that a deep-drawn web structure with numerous cavities is produced. After the web has passed through a roller gap, the deformed web, still bonded to the positive roller, is brought into contact with a perforating tool and perforated.

19 Claims, 6 Drawing Sheets

METHOD AND DEVICE FOR PRODUCING A STRUCTURED, VOLUMINOUS NON-WOVEN WEB OR FILM

BACKGROUND OF THE INVENTION

The invention relates to a method for producing a textured, voluminous non-woven web or velourized film from a thermoplastic by producing a non-textured web and subsequently processing said non-textured web using a pair of rollers. Said pair of rollers consists of a positive roller having numerous positive projections distributed over the roll sleeve surface and a negative roller having equally as many cavities. During the rolling process, the positive projections mesh with the cavities and stretch the web in the area of the roller engagements in such a manner that a deep-drawn web texture with numerous cavities is produced.

The above-mentioned method is used in particular for the production of textured, voluminous non-woven webs (DE 195 47 319 A1). For this, a raw web consisting of a large number of individual filaments or of staple fibers is produced from which a raw non-woven web is produced. This raw web is post-processed by a second pair of rollers, whereby the projections engage the cavities and stretch the raw web in the areas of roller engagement.

A similar method can also be used on a non-textured film or velour film, as is known from DE 195 24 076 C1.

Further, a device used to create a moisture-permeable film in which a film of thermoplastic material is heated to the point that adopts a deformation temperature approximating the thermoplastic temperature of the material is known from DE 78 04 47[8] U1. At this temperature, the film is inserted into a pressure gap and shaped during pressing and simultaneous cooling at the thermoplastic temperature range. The pressure gap is formed between a cooled and an engraved metal cylinder and an elastic roller. Behind the pressure gap, the film is further cooled while lying on the metal cylinder. Then the ends of the pressed items formed are caused to shrink by brief heating to, or above, the temperature used to shape the material, causing the openings to be formed.

This known method relates only to smooth film, however, and employs a temperature and shrink cycle that must be adjusted exactly. This results on the one hand in the limitation to a particular raw material, and on the other hand in a complicated temperature process.

SUMMARY OF THE INVENTION

The task is to provide an aperture, perforation, or thinning in the areas provided with cavities at the base of these cavities of a film or web produced in the known manner so that vapor or moisture permeability is possible through these perforations. The invention is therefore in the realm of technology of the production of perforated, three-dimensional webs, particularly as used for disposable hygienic products. For this, the particular task is to expand the method already developed in a relatively simple manner so that the three-dimensional, textured web produced according to that method is provided with perforations at the cavities in a reliable manner without requiring alteration to the basic procedure steps.

This task is solved by an invention manifested in two basic embodiments, whereby a textured web is produced in both cases that is more permeable than the non-textured web.

On the one hand, the method mentioned initially may be so expanded that, after the web has passed through roller gap, the deformed web still adhering to the positive roller may be contacted in the areas of the tips of the projections by a perforating, tearing tool that perforates and particularly tears it, whereby at least one perforation or thinning is created at the base of the cavities.

This procedure first deforms and then creates perforations. The reverse is also possible: the perforation may be implemented and then is torn further starting from the initial perforation. For this, it is recommended that, before the non-textured web is passed through the roller gap, it is perforated or thinned at the tips of the projections by a tool, and at least one perforation or thinning in the area of the base of the future cavities is implemented, and that the positive projections that engage into the cavities and stretch the web in the area of the roller engagement areas should further rip out the cavities at their tips and/or thin them during the rolling process.

Both procedure options represent embodiments of the invention, namely the basic concept that a padded web, namely a non-woven web or velour-textured film, will produce increased tension at the tip areas that is compensated in the course of the procedure and over a certain rest time, but will lead at the moment of formation to the fact that an existing rip or thinning will increase or stretch, so that a perforation or thinning (depending on the material selected) will arise at the desired location. The method is particularly suitable to the method known from DE 195 47 319 in which a non-woven web is used to produce a raw web that consists of a large number of individual filaments that are stretched and positioned irregularly into a fiber position whereby the initial stretching of the individual filaments occurs only in the area of 50% to 70% of their maximum possible length, and are subsequently pressed and welded, and are then processed in this form. The post-processing is then performed by engaging the projections that stretch the raw web in the area of roller engagement, leaving corresponding perforations behind.

It is also possible, however, to use another roller generally to perforate or thin the web that contacts the positive roller after the web has passed over it but is still in contact with it. Needle or heated rollers are the most suitable for this. Needle or heated rollers can be operated at a temperature of 140° C. to 200° C. in the contact areas.

The texturing of the product manufactured by the method based on the invention is improved in that the negative roller includes engraving that is the inverse of engraving on the positive roller, so that when the rollers are removed, protuberances, such as strips and projections arranged on the surface of one of the rollers, mesh with matching grooves and cavities on the surface of the opposite roller.

The projections on the positive roller are advantageously-arranged projections, and the surface of the negative roller includes laminated strips arranged parallel to the axis with cavities positioned between them, so that when the rollers rotate, the laminations mesh in the gaps held free by the projections.

The rollers of the roller pair can be made of metal. In particular, the metal for both rollers should possess the same Rockwell (HRC) hardness exceeding 50 HRC.

It is particularly advantageous to use rollers for the positive and negative rollers that include a metal core and whose roll sleeve surface is formed by a plastic coating of the roller core. Such a plastic sleeve can, in particular, be engraved by laser, whereby the roller may be quickly and cheaply provided with any type of pattern. Since an engraving laser may be very accurate and fully automated, the pattern can be applied with such high precision to the extent that it is possible to provide the plastic-coated surfaces of the positive and negative rollers with very fine patterns that engage each other.

The height of the projections is preferably between 0.8 and 2 mm. The three-dimensional texture of the non-woven web is in the foreground.

The mutual linear separation of the projections should be between 1 and 2.5 mm. The quantity of projections on 100 cm2 of roller surface is preferably between 2,000 and 3,000.

The projections can be produced in various pointed forms, e.g., they may be formed like an onion-shaped tower or a pyramid with a tip angle of 90°±20°.

The rollers can be at different temperatures during the procedure, whereby the temperature of the negative roller is preferably at a temperature at least 20° C. cooler than that of the positive roller.

Polyethylene, polypropylene, polyamide, polyvinyl alcohol, polyester, polyetherester, or polycarbonate has proved to be suitable as raw material for web production.

In general, all thermoplastics from which textured film may be produced according to known methods are suitable. Materials that are produced from the above-mentioned thermoplastics according to the spun-melt, carding, air-laid, spun-laced, or melt-blown procedures may be used for non-woven webs.

In order to improve stretching, it is recommended that the web be held tight at the roller edges during all stretching and perforating processes.

Surprisingly, a non-woven web, a film, or a velour film may be used as raw material that is passed through a roller pair consisting of a projection and a matrix roller, and, after being forced through the roller gap, is perforated by a heating roller pressed against the velour film at the projections, under friction if necessary. Manufacturing procedures for such velour films are known from Patent DE 195 24 076. Using this procedure, it is possible to create a hole in the base of the depression, so that the depression represents a small funnel. Total perforation of the non-woven web or other web is achieved, whereby the three-dimensionality already created, or to be created in a future step, is preserved. It is remarkable that the production speed could be increased to a rate of 300 meters per minute during the testing stage. This speed may particularly be increased by use of a higher projection roller temperature and a significantly lower negative roller temperature.

Additional pressing of the shaped web against the shaping positive roller can widen the opening. Fibers remaining there can be removed or melted off. The aperture structure of the non-woven web or web is thus improved.

Arranging a roller device as a part of a device to perform the above-mentioned procedure modifications is characterized in that the positive roller provided with positive bodies meshes with a negative roller, and an additional positive roller is placed after the roller pair whose positive areas coincide with the cavities of the negative roller as they rotate.

A needle roller may be placed after the roller pair by means of which the web still lying on the positive bodies and already provided with cavities may be perforated. A particularly dense needle roller that has at least 5 to 30 needles per cm2 of roller surface is required for this.

The above-mentioned second version of the procedure works in the opposite manner. For this, a precisely-textured, heated needle roller is required to effect the desired pre-perforation of the web. In the subsequent roller progression, the existing perforation is expanded and stabilized by the engagement of the positive roller. A matrix roller is placed in the middle of the roller stack. The positive roller is positioned below it. A heatable needle roller is positioned at the top of the roller stack that is provided with individual needles or groupings. The localization of the individual needles or groupings is compatible with the projections of the positive roller during their rotation. The needle roller rotates synchronously with the positive roller, and perforates a web as it passes through the first process at the locations where cavities will be created in a future step.

For this, the temperature of the needle roller at the tip of the needle is raised to 140° [and] 250° C. if dealing with polyethylene or polypropylene. This temperature is higher for polyesters and other plastics, e.g., 180° to 300° C.

The needle roller perforates the web mechanically or melts fibers or film, so that a stable pre-perforation is achieved. The web extracted from the positive roller also evinces a clear, defined opening after the cavities are established. Three-dimensionality is preserved. Thus, the opening made by the needle roller is very small, e.g., 0.05 to 0.1 mm in diameter. This diameter is then enlarged to 0.5 to 1.4 mm by the intentional engagement of the projection roller. The web material is selected to be suitably elastic.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
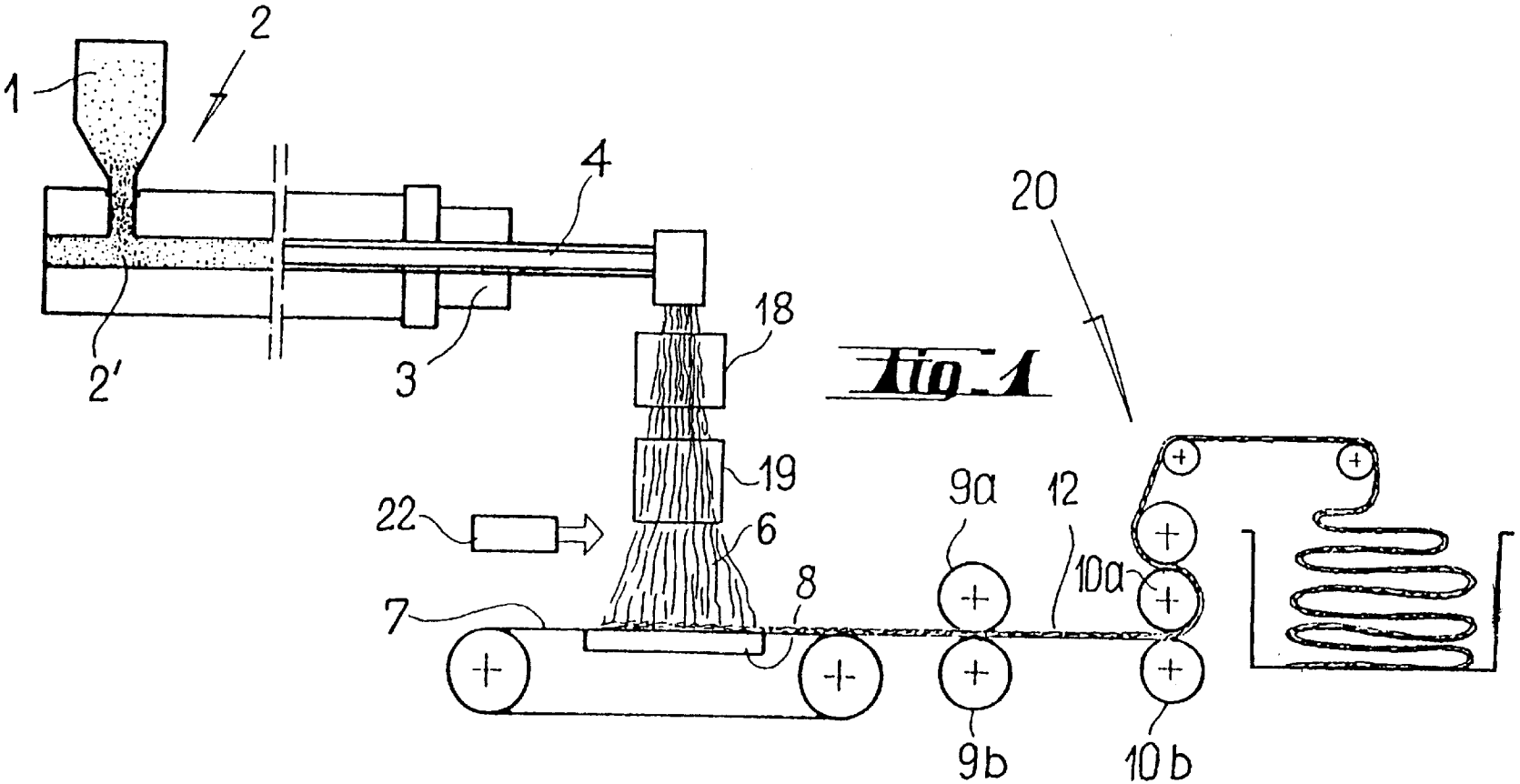
FIG. 1 schematically the manufacturing process of a three-dimensional textured non-woven web or film provided with holes.
Figure 2:
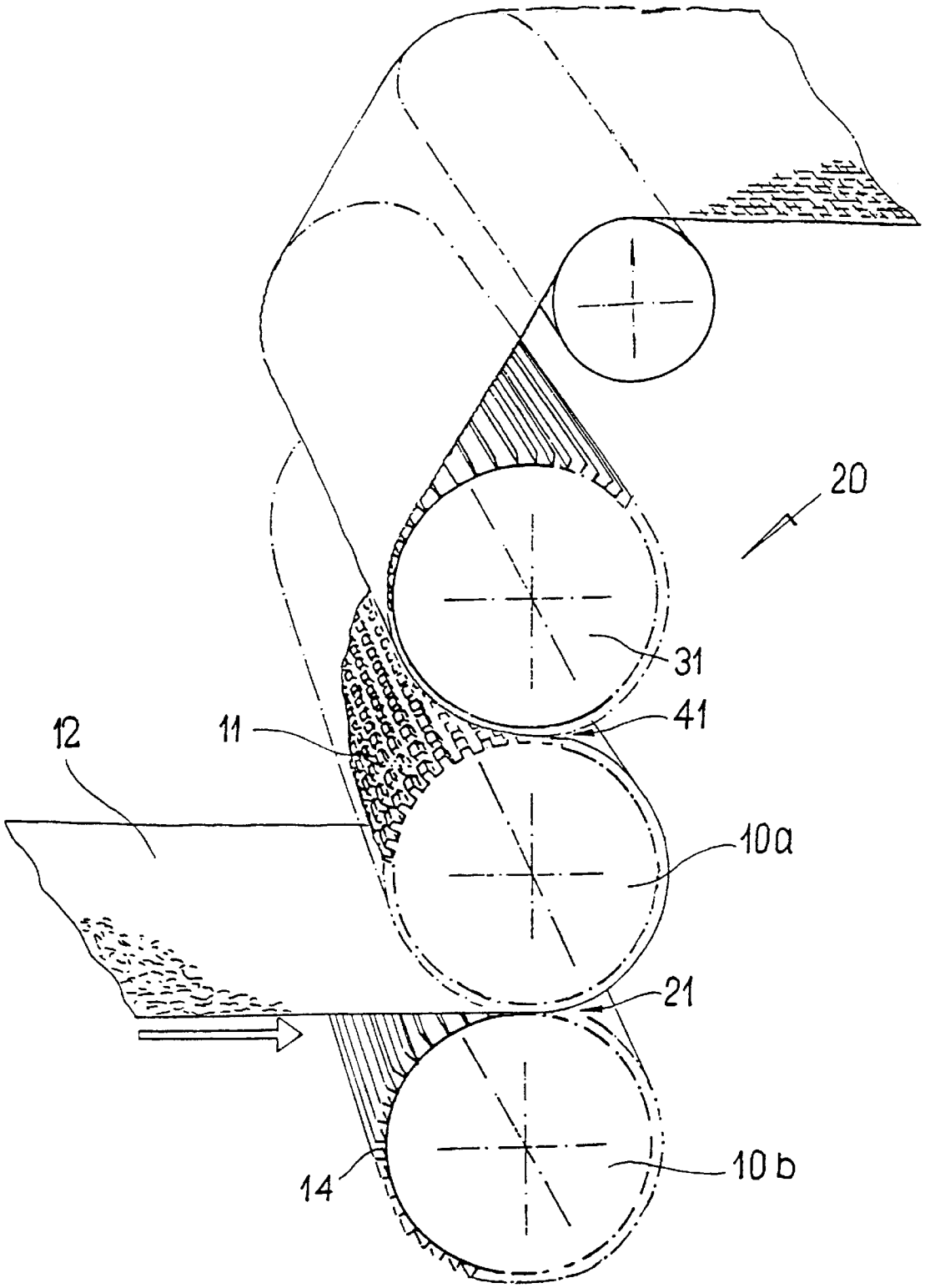
FIG. 2 an enlarged detail from FIG. 1, namely a roller arrangement.

The preferred embodiments of the present invention will now be described with reference to FIGS. 1–7 of the drawings. Identical elements in the various figures are designated with the same reference numerals.

FIG. 1 shows schematically the production process for a textured, voluminous non-woven web. A thermoplastic granulate, e.g., a polyethylene, polypropylene, polyamide, polyvinyl alcohol, polyester, polyether ester, or polycarbonate from which a web is to be produced is stored in a supply silo 1. It is passed to a heatable extruder 2, where it is plasticized and transferred by the extruder worm feed 2' to the extruder nozzle 3. Then the extrudate is fed via a guide nozzle 4 to a spinner jet, and, using the so-called spun-laced process, it is cooled and stretched as a filament in an attenuator 18. Here, the individual fibers are not fully stretched. A degree of stretching of only about 60 to 70% for polyethylene and polypropylene, or 50 to 70% for polyesters or polyamide, is advantageous. This is in contrast to the normal stretching conditions that indicate as full degree of stretching as possible, which is preferred on grounds of materials efficiency. In a so-called disperser 19, the fibers are tangled with each other and cooled (cooling fan 22). The stretched spun filament 6 is deposited on a net transport 7 that has a vacuum frame 8 below it, so that the tangled fibers lie flat on the net transport 7. It is then compressed between a first roller pair, namely calender rollers 9*a* and 9*b*. After processing, a raw non-woven web 12 is obtained. This has a surface weight of about 20 g/m2 and is only a few millimeters thick.

The raw filament then passes to a roller stack 20. The roller stack contains three rollers arranged on top of one another. Then the raw web 12 passes through the roller gap 21 between the two rollers 10*a* and 10*b*. Roller 10*a* is a positive roller with numerous projections distributed over the roller sleeve surface, as may be seen in FIG. 2. The projections may have the shape of a truncated pyramid or truncated sphere, or they may be pointed, e.g., as a pyramid with a tip angle of 90°±20°. After the web 12 has passed through the roller gap 21, the shaped web still adhering to the positive roller 10*a* at the tips of the projections is then passed through the next roller gap 41, where another negative roller 31 is positioned, but that is so arranged that the corresponding positive parts press against the projection exteriors and cause a perforation of the shaped web 12 in the area of the projection tips, which is expanded because of the tension. The film is then drawn over the top of the stack, and is now a three-dimensional textured film with defined apertures. The film is again pressed against the shaping projection roller, whereby the non-woven web aperture is formed and widened. The remaining fibers are removed or melted off.

Figure 3:
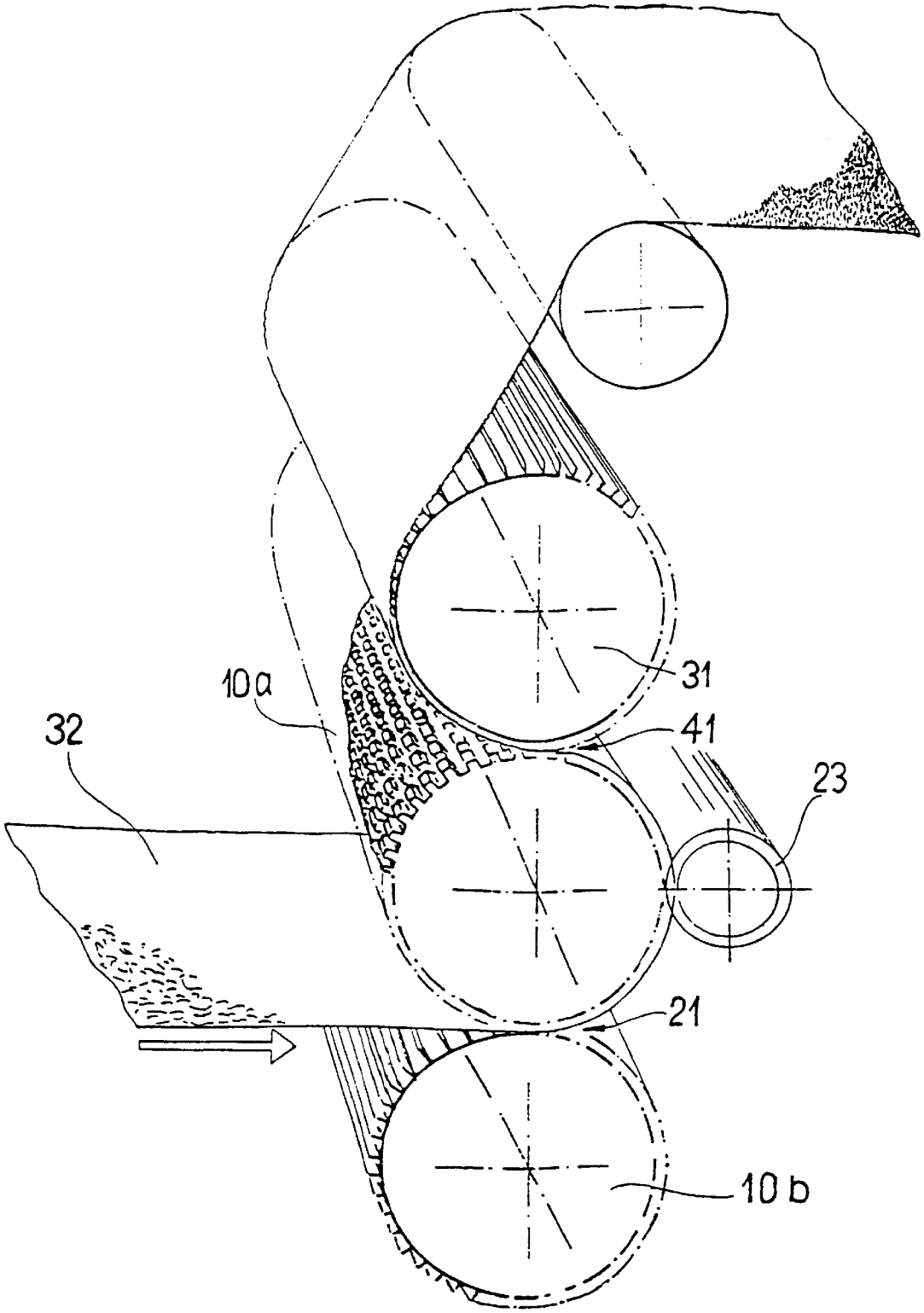
FIG. 3 a roller arrangement in another embodiment.

A velour film may be used instead of a non-woven web. FIG. 3 shows an example of processing such a film. The film passes as a non-textured web 32 with a material thickness of 60 mm with its velour side facing the projection roller 10*a* into the roller gap 21. In the roller gap 21, the non-textured web 32 is shaped and provided with a three-dimensional texture with numerous fine cylinders. The texture corresponds to that of the roller surface. A steel roller 23 heated to 140° C. is pressed against the roller 10*a* and is driven with light friction against the roller 10*a*. The heated roller that has a non-friction surface moves against the roller 10*a* rolling past it and causes an opening of the shrunken film and a tearing in the base area of the cavities. This forms a small funnel that has an opening at the bottom. After the second shaping step, the perforated and three-dimensionally shaped film is removed from the roller 31, and is cooled and wrapped up. The surface includes an even, very fine velour effect. Production of the film as such is described in Patent DE 195 24 076.

In particular, the multi-layer method described in that patent is used. The upper layer is 40 mm thick, and the rear layer is 20 mm thick. The upper film is a mixture of two HDPE products made according to the Metallocen procedure. The film additionally contains lubricants, pigments, stabilizers, and a parting compound. An HDPE is used that has a lower melting index for the rear side. The film can be produced and provided with a velour surface using the known Chill-Roll procedure. The projections created during the velour effect can also be stretched. Instead of the steel roller 23, a very dense brush roller with steel tips can be used. A film is fed into the roller gap 21, and then the brush roller is applied against the projections, so that thinnings and perforations result in the shaped film. Then the pre-textured depressions are pressed again, creating a very clear three-dimensional texture with openings in the bases of the cavities.

Figure 4:
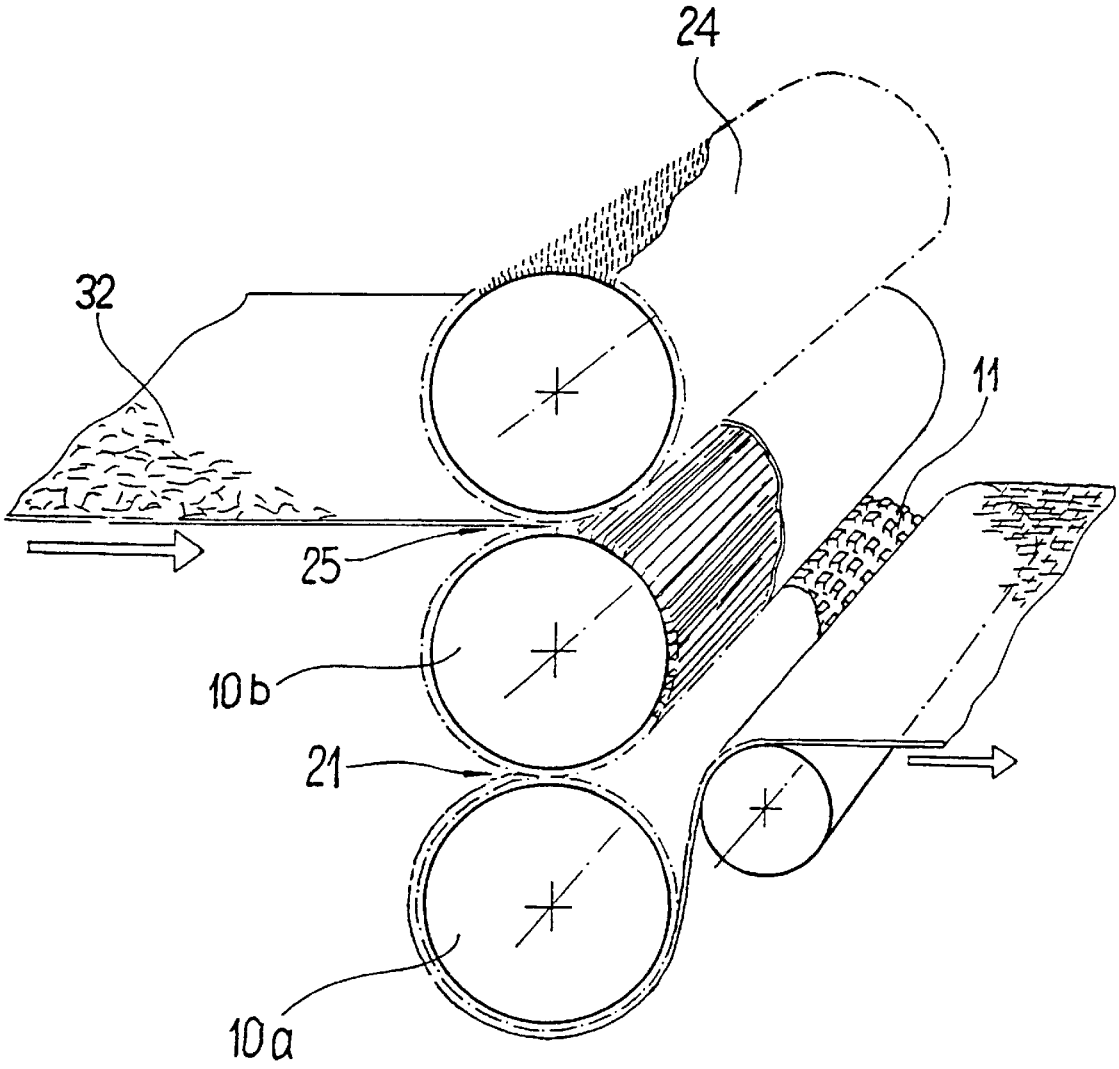
FIG. 4 another embodiment of roller arrangement.

In this example, the negative roller 10*b* is at a temperature of 40 to 60° C., the center roller about 150° C., and the upper negative roller 31 is at a temperature of from 40 to 60° C. The brush roller may also be heated to a temperature of 120 to 150° C. FIG. 4 shows a roller arrangement in which the non-textured web 32 is fed into a roller gap 25, whereby a needle roller 24 perforates or thins the material at the eventual tip area of the projections 11 before the non-textured web 32 passes through the roller gap 21, and at least one perforation or thinning is created in the base area of the cavity to be formed later. The film is then passed into roller gap 21, where the positive bodies, i.e., projections 11, engage into the cavities and stretch the web 32 in the areas of roller engagement. This causes further rips and/or thinning in the tip areas of the cavities. The textured and perforated web is removed from the roller 10*a* and passed on for further processing.

At this time, the temperature of the roller 10*a* is about 140 to 160° C., while the temperature of the roller 10*b* is only about 40° C. Needle tips of the needle roller 24 are heated to about 160° C. The roller stack shown in FIG. 4 may be used for non-woven web or films.

Figure 5:
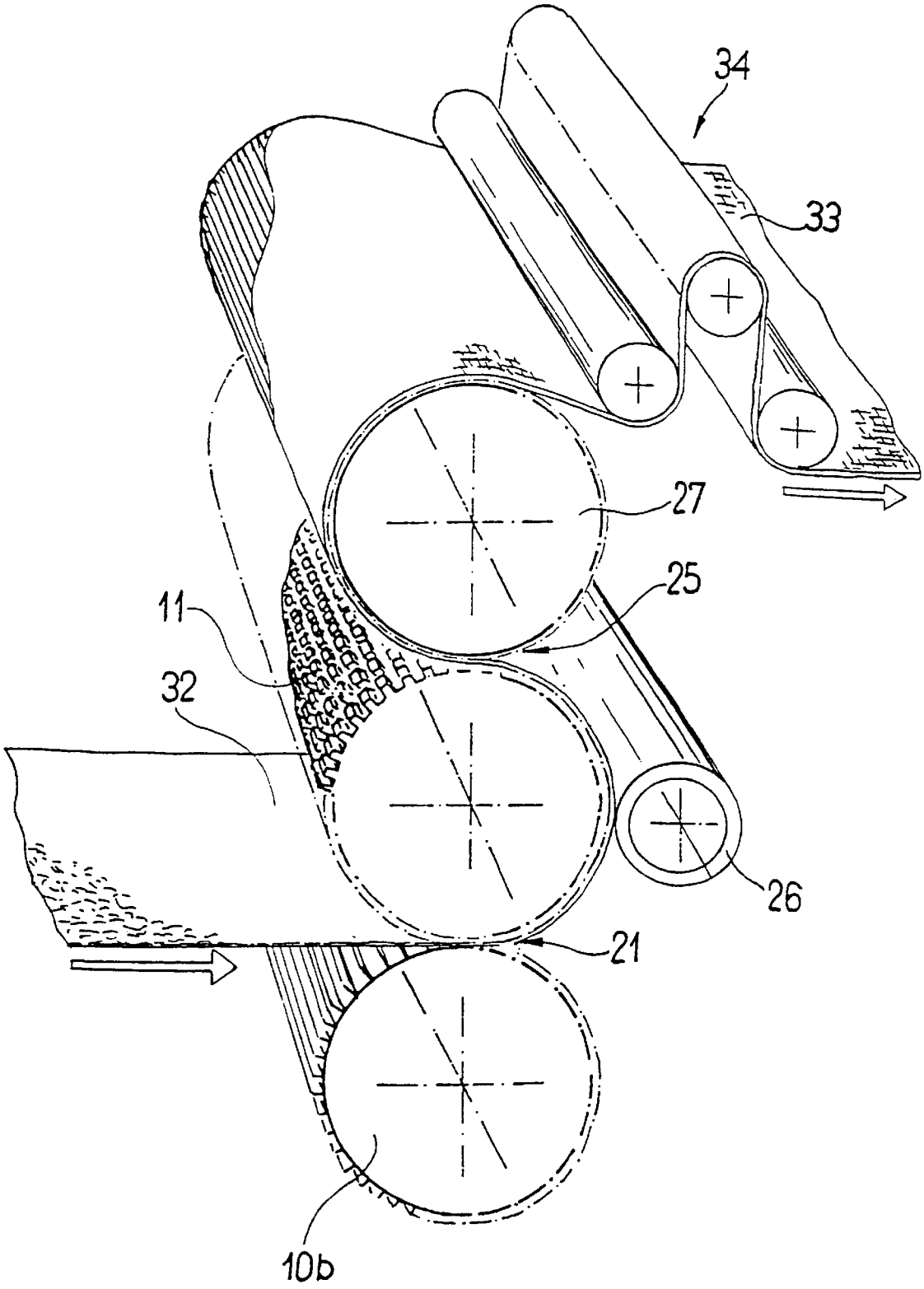
FIG. 5 another embodiment of roller arrangement.

FIG. 5 shows another option. Here, a textured or roughened or velourized film, or non-textured web 32, is fed into the roller gap 21 between a positive roller 10*a* and a negative roller 10*b*, and is subjected to initial texturing. By means of a heated roller 26 at a temperature of 120 to 130° C. and operating using light friction, the web lying on the projections 11 is ripped, i.e., provided with perforations and thinnings. Then the web is again fed into a gap 25 between a negative roller 27 and the positive roller 10*a*, where it is again deep-drawn and stretched. This roller is at a temperature of 60° C. The film material is again stretched so that the latent thinnings and perforations that are relatively small are enlarged, and an even three-dimensional texture with openings at the bases of the cavities results. The textured film 33 is removed by a film remover roller 34 and passed to a storage facility. An initial film based on polyethylene with elastic properties that is produced as a two-layer film is used for this. The film is provided with 2.5% titanium oxide and a lubricant. The initial film has a thickness of 50 mm, for example, and may then be used for hygienic applications. It possesses a rapid absorption capability of moisture and includes excellent re-wetting values because of its three-dimensionality. The film may acquire a very "dry grip" by the addition of kaolin, chalk, or titanium oxide.

Figure 6:
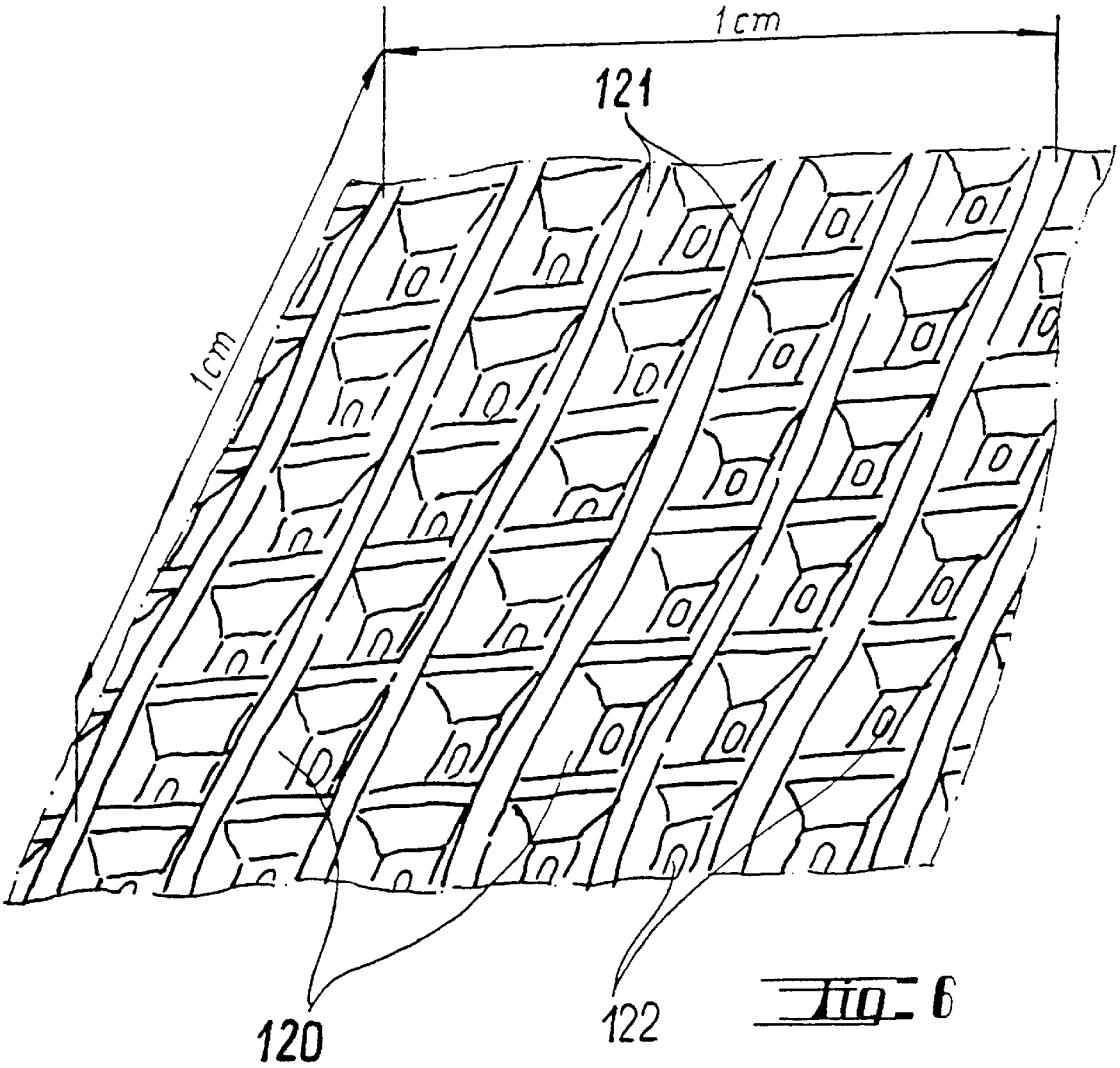
FIG. 6 an example of a three-dimensionally-textured film in schematic representation.

FIG. 6 shows an enlarged, schematic representation of a film texture. One may recognize that the depressions 120 have the shape of a truncated pyramid, and include perforations 122 at the bottoms of the cavities. The depressions are separated from one another by strips 121. The scale may be derived from the "1 cm" legend.

Figure 7:
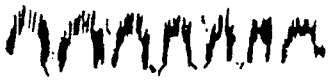
FIG. 7 a cross-section of another film texture.

FIG. 7 shows a similar texture. Here, a velour film is used that is provided with very fine cylindrical depressions that are also open at their bases.

There has thus been shown and described a novel method and device for producing a textured, voluminous non-woven web or film which fulfill all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. In a method for producing a textured, voluminous, non-woven web or velourized film from a thermoplastic, comprising the steps of producing a non-textured web, and passing the non-textured web between a pair of rollers that comprises a positive roller having numerous positive projections distributed over a surface thereof and a negative roller having equally as numerous cavities on a surface thereof, wherein, during the rolling process, the positive projections engage with the cavities in an interface between the rollers to stretch and shape the non-textured web in the area of the roller interface in such a manner that a deep-drawn web texture with numerous cavities is produced, the improvement comprising the step of contacting the web, after it has passed between the roller pair and the shaped web still adheres to the positive roller, in areas of tips of the projections, by a perforating needle roller that perforates and tears the web, thereby creating at least one perforation or thinning at the base of the cavities therein, so that the non-woven web or velourized film is made more permeable than the non-textured web.

2. Method as in claim 1, wherein, the step of producing a non-textured web comprises the steps of (1) producing a non-woven raw web which comprises a number of individual filaments that are stretched and deposited in a tangled manner in a fiber layer; (2) thereafter stretching the individual filaments up to 50 to 70% of the their total possible stretching; and then (3) pressing and welding the fiber layer prior to passing it between the pair of rollers.

3. Method as in claim 1, wherein the needle roller contacts the positive roller after the web has passed through the interface, but is still lying on the positive roller, to perforate or thin the web.

4. Method as in claim 3, wherein the needle roller has a needle tip temperature of between 140 and 200° C.

5. Method as in claim 1, wherein the negative roller includes engraving that is the inverse of engraving on the positive roller, so that when the rollers rotate together, strips and projections that are on the surface of one roller engage in matching grooves and cavities on the surface of the opposite roller, wherein projections of the positive roller are arranged in rows, and the surface of the negative roller includes laminated strips arranged parallel to the negative roller axis with cavities positioned between them, so that when the rollers rotate, the laminations engage in the gaps held free by the projections.

6. Method as in claim 5, wherein outer sleeves of the rollers are of metal.

7. Method as in claim 5, wherein at least one of the rollers includes an outer sleeve of laser-engraved plastic.

8. Method as in claim 5, wherein the rollers are heated to different temperatures.

9. Method as in claim 8, wherein the temperature of the negative roller is at least 20° C. cooler than that of the positive roller.

10. Method as in claim 1, wherein the non-woven web is stretched twice and, during a second stretching, the non-woven web is held at a temperature that is essentially the same as that prevailing during a first stretching.

11. Method as in claim 1, wherein the raw material for producing the non-woven web is selected from the group consisting of polyethylene, polypropylene, polyamide, polyvinyl alcohol, polyester, polyetherester, and polycarbonate.

12. Method as in claim 1, wherein the non-woven web is produced by a spun-melt, carding, air-laid, spun-laced, or melt-blown method.

13. Method as in claim 1, wherein the web is held tight at the roller edges during stretching.

14. Method as in claim 1, wherein a velour film is used as a raw material that is passed between the roller pair and the method further comprises the step of perforating the velour film by a heated roller pressed against velour film projections after passing through the roller interface.

15. Method as in claim 14, wherein a velour side of the velour film faces the projection roller.

16. A roller arrangement for performing the method according to claim 1, wherein the positive roller meshes with a negative roller to texture the web, and the needle roller is positioned after the positive and negative roller pair by means of which the web, already provided with cavities, is perforated in said cavities.

17. Roller arrangement as in claim 16, wherein tips of the individual needles and groups of needles are heated to a temperature between 140 and 250° C.

18. In a method for producing a textured, voluminous, non-woven web or velourized film from a thermoplastic, comprising the steps of producing a non-textured web, and passing the non-textured web between a pair of rollers that comprises a positive roller having numerous positive projections distributed over a surface thereof and a negative roller having equally as numerous cavities on a surface thereof wherein, during the rolling process, the positive projections engage with the cavities in an interface between the rollers to stretch the non-textured web in the area of the roller interface in such a manner that a deep-drawn web texture with numerous cavities is produced, the improvement comprising the step of perforating or thinning the non-textured web before it has passed between the roller pair, by means of a needle roller, whereby at least one perforation or thinning is created at the base of the cavities to be formed therein, and whereby, during the rolling process, the positive projections engage with the cavities and stretch the non-textured web and whereby the web is ripped or thinned in areas of its cavities so that the non-woven web or velourized film is made more permeable than the non-textured web.

19. Roller arrangement as part of a device to perform the method according to claim 18, wherein the needle roller comprises individual needles or groups of needles, for which localizations of the individual needles or groups of needles are compatible with the projections of the positive roller during rotation, are synchronous with the positive roller, and for which a non-textured web may be perforated during the first step of the method during the web's passage at the locations where cavities will be produced in the course of further web processing.

* * * * *